US011832641B2

(12) United States Patent
Nappi

(10) Patent No.: US 11,832,641 B2
(45) Date of Patent: Dec. 5, 2023

(54) SMOKING ARTICLE HAVING HIDDEN INDICIA

(71) Applicant: Philip Morris Products, S.A., Neuchatel (CH)

(72) Inventor: Leonardo Nappi, Hauterive (CH)

(73) Assignee: Philip Morris Products S.A., Neuchâtel (CH)

( * ) Notice: Subject to any disclaimer, the term of this patent is extended or adjusted under 35 U.S.C. 154(b) by 1120 days.

(21) Appl. No.: 14/769,905

(22) PCT Filed: Feb. 24, 2014

(86) PCT No.: PCT/IB2014/059215

§ 371 (c)(1),
(2) Date: Aug. 24, 2015

(87) PCT Pub. No.: WO2014/132181

PCT Pub. Date: Sep. 4, 2014

(65) Prior Publication Data

US 2016/0000141 A1 Jan. 7, 2016

Related U.S. Application Data

(60) Provisional application No. 61/769,998, filed on Feb. 27, 2013.

(30) Foreign Application Priority Data

Feb. 27, 2013 (EP) ..... 13157082

(51) Int. Cl.
*A24C 5/60* (2006.01)
*A24D 1/02* (2006.01)

(52) U.S. Cl.
CPC ..... *A24C 5/601* (2013.01); *A24D 1/02* (2013.01)

(58) Field of Classification Search
CPC ..... G07D 7/00; G07D 7/003; G07D 7/0032; G07D 7/0034; A24D 1/02; A24C 5/601
See application file for complete search history.

(56) References Cited

U.S. PATENT DOCUMENTS 4,184,700 A * 1/1980 Greenaway ..... B41M 3/14 283/17
4,236,538 A 12/1980 Foster et al.
2008/0251091 A1 10/2008 Schuetz et al.

FOREIGN PATENT DOCUMENTS

JP 2002-019255 A 1/2002
JP 2012-507287 A 3/2012
(Continued)

OTHER PUBLICATIONS

International Search Report and Written Opinion for PCT/IB2014/059215, issued by the European Patent Office, dated Jun. 17, 2014; 10 pgs.

(Continued)

*Primary Examiner* — Galen H Hauth
*Assistant Examiner* — Yana B Krinker
(74) *Attorney, Agent, or Firm* — Mueting Raasch Group

(57) ABSTRACT

Smoking articles include a marking that includes an indicia that is hidden when viewed from certain angles and visually distinct when viewed from other angles. The marking may be provided on a wrapper, such as a plug wrap, a smokable material wrap, or a tipping paper wrap. The marking may include aligned embossed and printed features with a portion being misaligned. The marking may include a coloured adjacent or surrounding region into which the indica may be hidden and from which it may appear, depending on the viewing angle. The marking may allow a consumer to identify the smoking article as genuine, as opposed to counterfeit.

21 Claims, 6 Drawing Sheets

(56) References Cited

FOREIGN PATENT DOCUMENTS

| | | | |
|---|---|---|---|
| RU | 2365316 | C2 | 8/2009 |
| RU | 2380993 | C2 | 2/2010 |
| WO | WO 2010/051076 | A1 | 5/2010 |
| WO | WO 2011/042354 | A1 | 4/2011 |
| WO | WO 2011/121328 | A2 | 10/2011 |
| WO | WO 2012/159887 | A1 | 11/2012 |

OTHER PUBLICATIONS

Extended European Search Report for EP 13157082.2, issued by the European Patent Office, dated Sep. 2, 2013; 5 pgs.
International Preliminary Report on Patentability for PCT/IB2014/059215, issued by the International Bureau of WIPO dated Sep. 11, 2015; 8 pgs.
Russian Decision to Grant for RU Application No. 2015141071, dated Jan. 16, 2018; Including English Translation of Decision to Grant: 17 pgs.

* cited by examiner

SMOKING ARTICLE HAVING HIDDEN INDICIA

This application is the § 371 U.S. National Stage of International Application No. PCT/IB2014/059215, filed 24 Feb. 2014, which claims the benefit of U.S. Provisional Application No. 61/769,998, filed 27 Feb. 2013, and European Application No. 13157082.2, filed 27 Feb. 2013.

This disclosure relates to smoking articles and wrappers for smoking articles having a hidden indicia.

Combustible smoking articles, such as cigarettes, typically have shredded tobacco surrounded by a paper wrapper forming a tobacco rod. A cigarette is employed by a smoker by lighting one end of the cigarette and burning the shredded tobacco rod. The smoker then receives mainstream smoke into their mouth by drawing on the opposite end or mouth end of the cigarette, which typically contains a filter. The shredded tobacco can be a single type of tobacco or a blend of two or more types of tobacco depending on the brand of cigarette.

Other known smoking articles include, for example, smoking articles in which an aerosol is generated by electrical heating or by the transfer of heat from a combustible fuel element or heat source to an aerosol generating substrate. During smoking, volatile compounds are released from the aerosol generating substrate by heat transfer from the heat source and entrained in air drawn through the smoking article. As the released compounds cool they condense to form an aerosol that is inhaled by the consumer. Also known are smoking articles in which a nicotine-containing aerosol is generated from a tobacco material, tobacco extract, or other nicotine source, without combustion, and in some cases without heating, for example through a chemical reaction.

Various portions of smoking articles may contain a wrapper or housing that is visible to a consumer. For example, the filter rod of a cigarette is typically wrapped with plug wrap paper, tobacco rods are typically wrapped with cigarette paper, and the tobacco rod and filter rod are typically attached with tipping paper. Non-combustible smoking articles may have similar wrappers or housings to contain components of the smoking article. Portions of the plug wrap, cigarette paper, tipping paper, other wrappers or housings of smoking articles may be visible to a consumer.

The housings or wrappers are typically plain white or coloured. Sometimes indicia, such as an image, logo or text, is printed on one or more of these wrappers so that a user may readily recognize and identify a product. At least one published patent application, WO 2011/042354, describes wrappers having aligned printed patterns and embossed V-shaped features where one side of the feature is provided with one colour and the other side is provided with another colour such that, when viewed from different angles, a different colour predominates.

While indicia such as images, logos, text, or colour shifting may be used to identify a genuine product, the number of counterfeit smoking articles continues to increase. Accordingly, more sophisticated mechanisms for identifying a product as genuine may be desired to deter counterfeiting.

One object of this disclosure is to describe smoking articles, or wrappers thereof, having indicia that are more difficult to counterfeit than previously described indicia. The indicia may allow a user to more readily identify the smoking article as genuine. In embodiments the indicia is visible only from a certain angle or certain angles, while it is hidden when viewed from other angles.

Another object of this disclosure is to describe smoking articles, or wrappers thereof, that have a hidden indicia that becomes visible when viewed from certain angles. Such smoking articles and wrappers may be more readily accepted by a user as being an indicia of authentication.

In a first aspect, a smoking article or a wrapper or housing for a smoking article includes an indica that is hidden with, or in, an adjacent portion when viewed from at least one angle and that becomes visible relative to the adjacent area when viewed from at least one other angle. For example, in embodiments, a smoking article or wrapper or housing for a smoking article comprises a marking including a patterned portion and an adjacent portion. The patterned portion includes a printed pattern and an embossed pattern aligned with the printed pattern. The printed pattern comprises a first colour and an adjacent second colour. The first colour of the printed pattern is provided on a side of an embossed feature visible from a first angle and the second colour of the printed pattern is provided on a second side of the embossed feature visible from a second angle. The first colour and adjacent second colour blend when viewed from a third angle to produce a third colour. The adjacent portion of the marking is provided with one of the first, second or third colours. Accordingly, when the aligned embossed features and coloured features are viewed from a certain angle, they are not readily distinguished from the adjacent portion. For example, where the adjacent portion is of the third colour, the aligned embossed features and coloured features are hidden in or with the adjacent portion when viewed from the third angle. However, when viewed from the first or second angles, the aligned embossed features and coloured features are distinguishable from the adjacent portion and are not hidden.

In a second aspect, a smoking article or a wrapper or housing for a smoking article includes an indicia that becomes visible when viewed from a selected range of angles. For example, in embodiments, a smoking article or a wrapper or housing for a smoking article comprises a marking including a printed pattern and an embossed pattern aligned with the printed pattern. The printed pattern comprises a first colour and an adjacent second colour. In a first portion, the embossed pattern is in register with the printed pattern, such that the first colour is printed on a first side of an embossed feature visible from a first angle and the second colour is printed on a second side of the embossed feature visible from a second angle. In a second portion, the embossed pattern is offset relative to the printed pattern, such that the second colour is printed on a side of an embossed feature visible from the first angle. The adjacent first and second colours blend when viewed from a third angle to produce a third colour. Accordingly, in some embodiments, the indicia may be visible when viewed from the first angle, but is hidden when viewed from the second or third angles.

In a third aspect, a smoking article or a wrapper or housing for a smoking article includes an indicia that is hidden when viewed from a selected range of angles. For example, in embodiments, a smoking article or a wrapper or housing for a smoking article comprises a marking including a printed pattern and an embossed pattern aligned with the printed pattern. The printed pattern comprises a first portion and a second portion. The first portion of the printed pattern comprises a first colour and an adjacent second colour. The second portion of the printed pattern comprises the first colour and an adjacent third colour. In the first portion, the embossed pattern is in register with the printed pattern, such that the first colour is printed on a first side of an embossed feature visible from a first angle and the second colour is printed on a second side of the embossed feature visible from a second angle. In the second portion, the embossed pattern is in register with the printed pattern, such that the first colour is printed on a side of an embossed feature visible from the first angle and the third colour is printed on a second side of the embossed feature visible from the second angle. Accordingly, in some embodiments, the indicia may be hidden when viewed from the first angle, but may become visible when viewed from the second or third angles.

In each of the embodiments of the various aspects discussed above, a printed pattern is aligned with an embossed pattern such that a hidden indica becomes visible when viewed from one or more angles. Where the printed pattern and the embossed pattern are in register with one another over a portion of the marking, the first colour predominates when viewed from the first angle and the second colour predominates when viewed from the second angle. Where the printed pattern and the embossed pattern are offset, the second colour predominates when viewed from the first angle or a third colour, which comprises a blending of the first and second colours, predominates. Despite one or more portions of the printed pattern and the embossed pattern being offset, it will be understood that overall, the printed pattern and embossed pattern are considered to be aligned to the extent that the desired appearance and disappearance of the indicia is achieved.

One or more embodiments of the smoking articles or wrappers described herein may provide one or more advantages over previously produced or described smoking articles or wrappers for smoking articles. For example, enhanced complexity of patterns and disruptions thereof or hidden indicia may result in a smoking article or wrapper that is more difficult to counterfeit or that provides a user with more assurance that the smoking article in genuine. In addition, the smoking articles or wrappers described herein provide a manufacturer with more flexibility and choice for marking smoking articles, including the ability to produce a hidden indicia. These and other advantages will be apparent to those of skill in the art upon reading this disclosure.

Any suitable smoking article or wrapper or housing for a smoking article may include a marking described herein. The term "smoking article" includes cigarettes, cigars, cigarillos and other articles in which a smokable material, such as a tobacco, is lit and combusted to produce smoke. The term "smoking article" also includes articles in which smokable material is not combusted, such as but not limited to smoking articles that heat a smoking composition directly or indirectly, or smoking articles that neither combust nor heat the smoking composition, but rather use air flow or a chemical reaction to deliver nicotine or other materials from the smokable material.

Typically, a smoking article is in a form that allows for a user to grasp the article and inhale smoke, if desired. Smoking articles include a smokable composition and often include a filter disposed downstream of the smoking composition to filter constituents released from the smoking composition. A smoking article typically has outer wrappers or other elements such as a housing that is visible to a consumer. The housing may contain the smokable composition or a filter.

The marking may be provided on, or incorporated in, a wrapper, a housing or any other component of the smoking article visible to the consumer. Regardless on which component of a smoking article the marking is provided, the marking is provided on a visible area of the smoking article. It will be understood that a "visible area" is an area of the article visible to a user. Preferably, the marking is provided on an exterior surface. Of course, the marking may be provided on a surface other than an exterior surface. For example, if one or more exterior layers, or portions thereof, of the smoking article are transparent or semi-transparent or include a window, underlying layers, or portions thereof, may be visible from the exterior of the fully assembled article. Thus, underlying layers or portions thereof, in some embodiments, may provide visible areas. For the purposes of this disclosure, the term "substantially transparent" is used herein to describe a material which allows at least a sufficient proportion of incident light to pass through it so that it is possible to see through the material.

In embodiments, the component on which the marking is provided is a wrapper, such as a plug wrap, cigarette paper, a tipping paper, or other suitable wrapper of a smoking article. Typically, a wrapper of a smoking article is formed from paper or other material, such as cellulosic based materials. In other embodiments, the wrapper is a film, such as a cellulosic film or other film such as a polylactic acid film. The film may be substantially or entirely transparent.

If the marking is provided on a transparent or semi-transparent component or portion of the smoking article, the marking may be provided on the inner surface of the transparent or semi-transparent component or portion as the marking will be exteriorly visible through the transparent component or portion, such as a transparent film wrapper. The marking may also be provided on or incorporated into a component underlying a transparent component or portion.

Any marking may be provided on or in the smoking article or a component of the smoking article. For example, the marking may be a form of indicia. As used herein, "indicia" refers to a discrete visual element or repeating element or pattern. The indicia may be in the form of a logo, text, image, pattern, or the like, or combinations thereof. By way of example, the indicia may comprise a brand or manufacturer logo that allows a consumer to identify the type or origin of the smoking article. The indicia may be aligned with the longitudinal axis of the smoking article, generally perpendicular to the longitudinal axis of the smoking article, or at any other angle other than parallel or perpendicular to the longitudinal axis of the smoking article. If the indicia is aligned with the longitudinal axis of the smoking article, the indicia, or portions thereof, may appear and disappear from view as a consumer pivots the smoking article. If the indicia is aligned perpendicular to the longitudinal axis of the smoking article, the indicia, or portions thereof, may appear and disappear as a consumer rotates the smoking article around the longitudinal axis of the smoking article.

A marking includes a combination of printed features and embossed features. Preferably, the printed features are a printed pattern. In embodiments, the pattern includes first and second colours adjacent one another so that one colour is present on one side of an embossed feature and another colour is present on another side of an embossed feature. In some embodiments, the first or second colour is provided by the colour of the embossed material. That is, another colour is not added to the area corresponding to the first or second colour. In other embodiments, the colors are added to the areas corresponding to both the first and the second colors.

The embossing and printing may occur in any order, such as printing first, embossing first, or printing and embossing at the same time. In embodiments, the marking is generated by first printing and then embossing. Any suitable printing process may be employed. For example, gravure, such as rotogravure printing, offset printing, flexography printing or digital printing, such as inkjet or laserjet printing, may be used. Any suitable material may be printed, such as ink, dye, pigment, or the like.

Any suitable embossing process may be employed. For example, plates or rollers having features corresponding to the desired embossing features may be used. Sheets of embossed wrappers may be produced prior to manufacturing of the smoking article, in which case a smoking article manufacturing apparatus may include a surface relief pattern matching the embossed pattern on the wrapper to prevent damage to embossed features due to, for example, crushing by rollers or the like. In embodiments, embossing, printing, or both embossing and printing, occurs in-line in the smoking article manufacturing process.

The combination of printing and embossing are aligned to generate indicia that are hidden when viewed from certain angles, but that are visible when viewed from other angles. In embodiments, a marking includes a printed pattern and an embossed pattern in register with the printed pattern over a first portion of the smoking article or wrapper and offset with the printed pattern over a second portion of the article or wrapper. The printed pattern includes first and second colours as described above. The first and second colours are preferably printed adjacent one another and are of sufficiently small widths so as to blend when viewed from a particular angle to produce a third colour. In the portion where the printing pattern and the embossed pattern are in register, the first colour is provided on a first side of an embossed feature that is visible when viewed from a first angle. The second colour is provided on a second side of the embossed feature that is visible when viewed from a second angle. Thus, in the portion where the printed pattern and the embossed pattern are in register, the first colour is visible when the smoking article is viewed from the first angle, the second colour is visible when the smoking article is viewed from the second angle, and the third colour (the blended colour) is visible when the smoking article or wrapper is viewed from a third angle.

In the second portion, where the embossed pattern is offset with the printed pattern, the second colour is printed on a side of an embossed feature visible from the first angle. Thus, the indicia that is hidden when viewed from the third angle is visible when viewed from the first angle due to the visibility of the second colour from the first angle in the regions where the embossed pattern and the printed pattern are misaligned.

In embodiments, an indicia is printed on a wrapper or other component of a smoking article such that alternating strips, or other suitable alternating features, of a first colour and a second colour are adjacent to one another. The strips or other suitable features may be straight, curved, wavy, or of any suitable or desirable shape. Preferably the adjacent strips or features are sufficiently narrow so that the first and second colours, when viewed from an appropriate angle, are not visually distinguishable and blend to produce a third colour. In embodiments, the adjacent strips or features are of a width of about 10 micrometers or less, such as about 5 micrometers or less, about 2 micrometers or less, or about 1 micrometer or less. Generally, the strips or features will be of a width of about 50 nanometers or greater, such as about 100 nanometers or greater or 500 nanometers or greater. In embodiments, the strips are from about 1 micrometer to about 8 micrometers in width.

Preferably the adjacent strips or features have colours selected from primary colours, such as red, yellow or blue, or from secondary colours, such as green, orange or violet. By way of example, if the adjacent strips are sufficiently narrow and are blue and yellow, pattern or indicia produced by the strips will appear green when viewed from an appropriate angle.

In areas where the embossed features are registered with the printed pattern such that the first printed colour is provided on a first side of the embossed features that are visible from a first angle and the second printed colour is provided on a second side of the embossed features that are visible from a second angle, a peak of the embossed feature preferably demarcates the intersection of the first printed colour and the adjacent second printed colour. In embodiments, the colour provided on one side of an embossed feature may be partially present on the other side of the embossed feature, which may result in a smoother shift between the two colours, may create a shading effect, or may increase a movement effect.

The embossed features may be of any suitable shape, such as having an upside-down V-shaped or U-shaped cross section. In embodiments, the embossed features are generally in the shape of a prism.

In embodiments, the embossed features have a ridge having a peak. The peak may be flattened, rounded, sharp or the like. Ridges having flattened or rounded peaks may be more easily manufactured than ridges having a sharp peak. The top surface of a ridge having a flattened or rounded peak can be provided with the third colour or can be provided with both the first colour and the second colour, which may provide an overall blended colour when viewed from the third angle. The boundary between the colors may be approximately in the middle of the top surface. This type of flattened or rounded peak may also allow for more tolerance in the alignment of the printed pattern with the embossed pattern because the boundary between the first and second colours would not require precise alignment as in the case of a sharp peak.

The embossed features may be of any suitable height, width and length. In embodiments, the width, the height, or both the width and the height, of the embossed features are about 10 micrometers or less, such as about 5 micrometers or less, about 2 micrometers or less, or about 1 micrometer or less. Generally, the height, the width, or both the width and the height, of the embossed features will be about 50 nanometers or greater, such as about 100 nanometers or greater or 500 nanometers or greater. In embodiments, the height and width of the embossed features are from about 1 micrometer to about 5 micrometers. The height and width may be the same or different. One or more of the embossed features may be of the same or different height and width. Preferably, all of the embossed features are of substantially similar height and width. Preferably, the height and width of the embossed features is substantially the same along the length of the feature.

The embossed features may have any suitable slope. For example, if the cross sectional shape of an embossed feature is V-shaped or if the embossed feature is a prism, the slope of a side of the feature may be from about 20 degrees (°) to about 80 degrees (°). Preferably, the slope is from about 30 degrees (°) to about 70 degrees (°). The slope of one side may the same or different from the slope of another side. Preferably, the width of a printed strip is about equal to the length from a base to a peak of an embossed feature.

As indicated above, in predetermined locations, the registration of the printed pattern or strips and the embossed features is offset. The printing may be offset from the embossing, or the embossing may be offset from the printing. In either case, the length of the offset is preferably equal to half or an integer multiple of the width of a printed strip. Preferably the length of the offset is equal to the width of one printed strip. If the offset is equal to the width of one printed strip, the second colour will be provided on a first side of the embossed feature and the second colour will be visible from the first angle. If the offset is equal to the half the width of one printed strip, the side of the embossed feature visible from the first angle will include both the first and second colours. Accordingly, the second colour will be visible from the first angle as a blended third colour as half of the width of the first side of the embossed feature will be provided with the first colour and half will be provided with the second colour.

In the portion or area where the printed features and embossed features are in registration with each other, as well as where the printed features and embossed features are offset, a first side or face of an embossed feature is preferably viewable from a first angle orthogonal to the first side. A second side or face of the embossed feature is preferably viewable from a second angle orthogonal to the second side. Preferably, at a third angle between the first and second angles, both the first side and the second side of the embossed feature are visible and the colours on either side of the embossed feature blend when viewed from the third angle. It will be understood that only the first side of the embossed feature will be visible from a range of angles around the first angle, that only the second side of the embossed feature will be visible from a range of angles around the second angle, and that both the first and second sides will be visible from a range of angles around the third angle. By way of example and in various embodiments, only the first side, or predominantly only the first side, will be visible when view from an angle that is about +25 degrees from the first angle; only the second side, or predominantly only the second side, will be visible when view from an angle that is about ±25 degrees from the second angle; and both the first and second sides will be visible, preferably to produce a blended colour, when view from an angle that is about +25 degrees from the third angle.

It will be understood that a marking that includes a combination of embossed and printed features, when incorporated into a smoking article, may have different visual effects than when incorporated on or in a flat component, such as a wrapper, to be incorporated into the smoking article. For example, when incorporated on or in an article having a flat surface, the angles at which different aspects of marking is viewed will be substantially similar across the entire marking. However, when incorporated in or on a curved surface or when a flat surface is curved, different portions of the marking may be viewed from different angles relative to flat surface. For example, on a flat surface, a first colour will be viewable from a first angle and a second colour will be viewable from a second angle if a pattern of embossed features and printed features includes peaks of the embossed features located at the intersections of adjacent strips of first and second printed colours. However, curving the flat surface into a cylinder may result in portions of the first colour being visible, portions of a blended colour being visible and portions of the second colour being visible when viewed from a particular angle, particularly if the printed and embossed features are parallel to the longitudinal axis of the smoking article. However, if the printed and embossed features are generally perpendicular to the longitudinal axis of the smoking article, curving should not have a significant effect on the visual appearance of the marking, relative to the appearance when flat.

In embodiments, a marking includes a portion adjacent to a patterned portion that includes a combination of embossed features and printed features. The combination of embossed and printed features may be as described above. The alignment of the embossed and printed features may be in register throughout the patterned portion or may include portions that are in register and portions that are offset as described above. As described above, the patterned areas may be viewed from a third angle that allows a viewer to observe both sides of an embossed feature such that colours provided on either side blend to form a third colour. The portion adjacent to the patterned portion is coloured a colour the same as the first, second or third colour. When viewed from an angle at which a colour visible in the patterned portion is the same as the adjacent potion, the adjacent portion and the patterned portion are visually indistinguishable or substantially visually indistinguishable. However when viewed from an angle where the colour visible in the patterned portion is different from the colour in the adjacent portion, the patterned portion will become visually distinguishable from the adjacent portion. Thus the patterned portion may be hidden when viewed from the third angle and may become visible when viewed from the first or second angle. Thus, the patterned portions, which may be in the form of an indicia, may be hidden when viewed from certain angles and may become visually distinguishable when viewed from other angles. In embodiments, the adjacent portion at least partially or fully surrounds the patterned portion. Alternatively, the patterned portion may at least partially or fully surround the adjacent portion.

All scientific and technical terms used herein have meanings commonly used in the art unless otherwise specified. The definitions provided herein are to facilitate understanding of certain terms used frequently herein.

As used herein, the singular forms "a", "an", and "the" encompass embodiments having plural referents, unless the content clearly dictates otherwise.

As used herein, "or" is generally employed in its sense including "and/or" unless the content clearly dictates otherwise. The term "and/or" means one or all of the listed elements or a combination of any two or more of the listed elements.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising", and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

As used herein, a "patterned" portion is a portion that includes a combination of one or more embossed features and printed features that produce different visual effects when viewed from different angles. The patterned portion may, but need not, be in the form of a repeated pattern.

For the purposes of the present disclosure, black, white and gray are considered colours.

Referring now to FIGS. 1-5, schematic drawings are depicted that illustrate various aspects of smoking articles or components of smoking articles that have or may have a marking as described above. Preferably the marking produces a hidden indicia when viewed from certain angles and produces a visually distinguishable indicia when viewed from other angles. The drawings are not necessarily to scale and are presented for purposes of illustration and not limitation. The drawings depict various aspects described in this disclosure. However, it will be understood that other aspects not depicted in the drawings fall within the scope and spirit of this disclosure. Like numbers used in the figures refer to like components, steps and the like. However, it will be understood that the use of a number to refer to a component in a given figure is not intended to limit the component in another figure labelled with the same number. In addition, the use of different numbers to refer to components is not intended to indicate that the different numbered components cannot be the same or similar.

FIGS. 3A-D are schematic views of a marking shown from generally opposing perspectives (A, B) and when viewed from angles X (C) and Z (D).

FIGS. 4A-D are schematic views of a marking viewed from top-down (A) and sectional views through lines B-B' (B), C-C' (C), and D-D' (D).

Figure 5A:
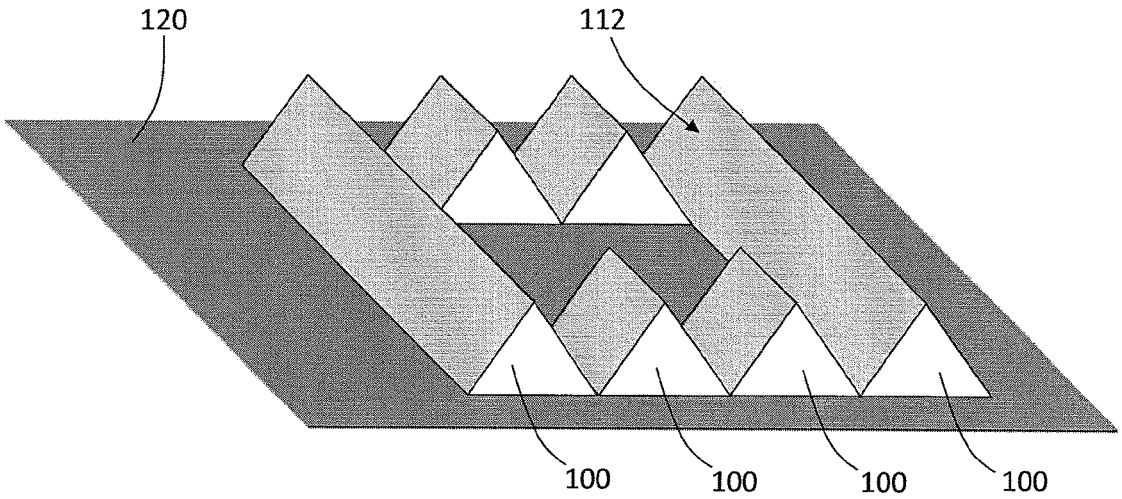
Figure 5B:
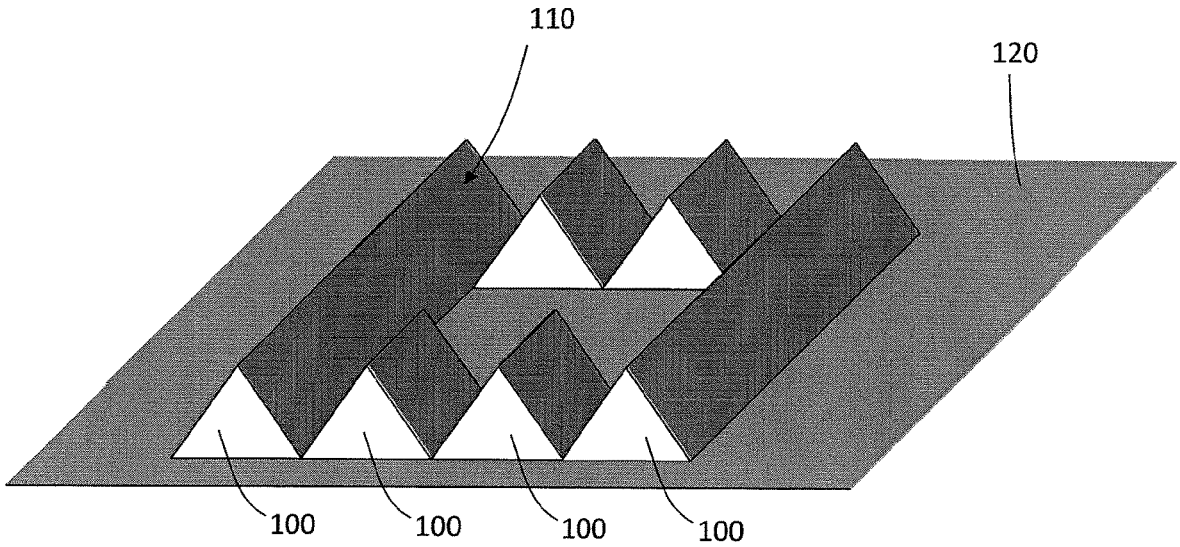

FIGS. 5A-B are schematic generally opposing perspective views of a marking having a patterned portion and an adjacent portion.

Figure 6A:
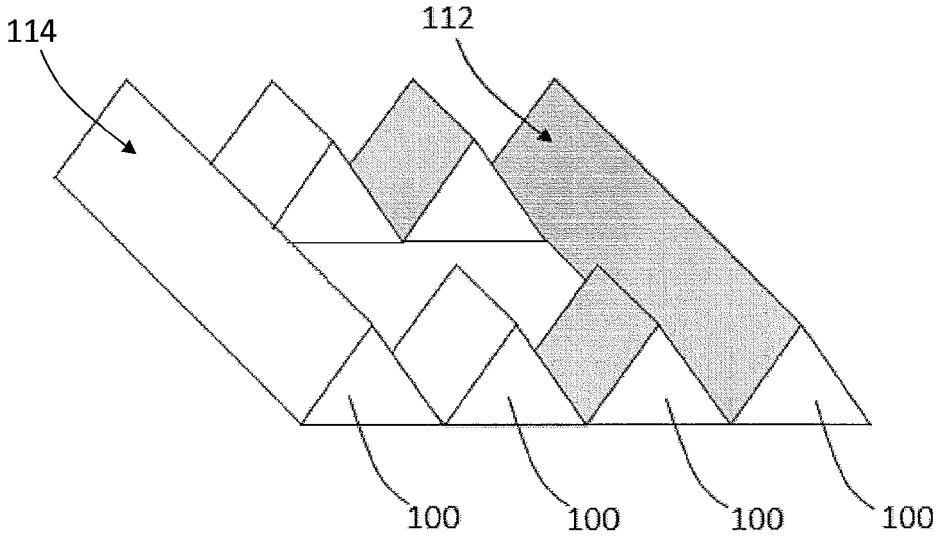
Figure 6B:
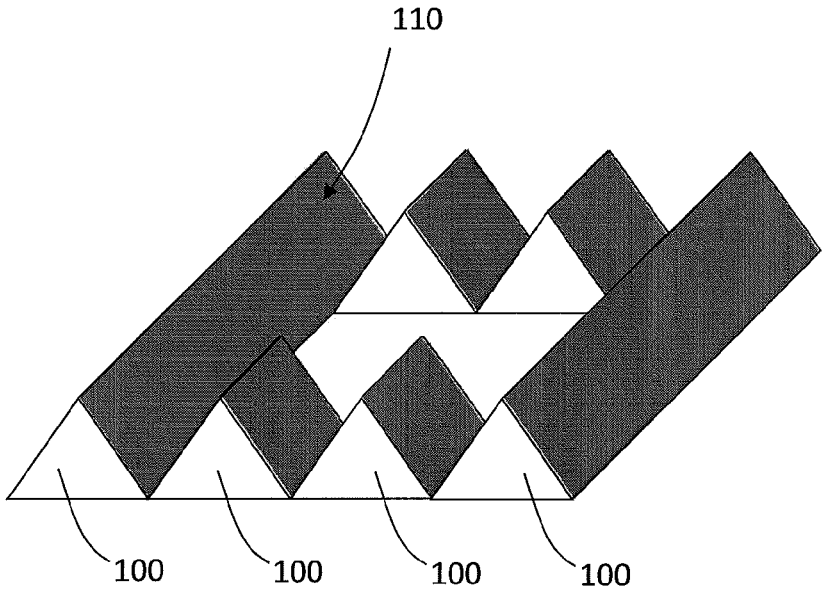

FIGS. 6A-B are schematic generally opposing perspective views of a marking.

The schematic drawings presented herein are not necessarily to scale, but are shown merely for purposes of illustration.

Figure 1:
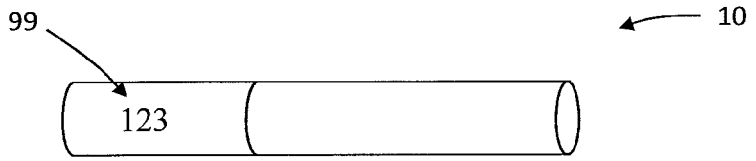
FIG. 1 is a schematic perspective view of an embodiment of a smoking article having a marking.

Referring now to FIG. 1, a smoking article 10 is depicted. The smoking article 10 has a marking 99 that is visible to a consumer when viewed from a suitable angle. As indicated above, the marking may be provided on or in the article 10 or component thereof. In FIG. 1, the marking 99 is depicted as three numbers, "123." The three numbers may be considered as a single marking or as three different markings.

Figure 2:
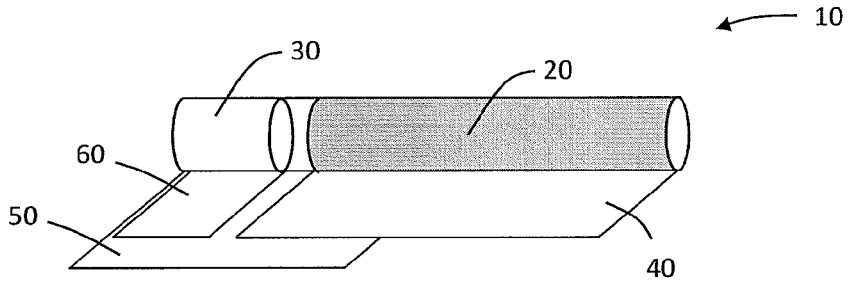
FIG. 2 is a schematic perspective view of a smoking article having wrappers on which a marking may be provided.

Referring now to FIG. 2, a partially unrolled smoking article 10, in this case a cigarette, is depicted. The smoking article 10 includes a tobacco rod 20 and a mouth end filter 30. While depicted as being separated by a gap, the tobacco rod 20 and filter 30 may abut one another. The smoking article 10, includes a plug wrap 60 that circumscribes at least a portion of the filter 30 and cigarette paper 40 that circumscribes at least a portion of the tobacco rod 20. Tipping paper 50 or other suitable wrapper circumscribes the plug wrap 60 and cigarette paper 40 as is generally known in the art. The marking, such as marking 99 depicted in FIG. 1, may be provided on the plug wrap 60, the cigarette paper 40, or the tipping paper 50. If the marking is provided on the plug wrap 60 or the cigarette paper 40 at a location that is covered by the tipping paper 50, at least a portion of the tipping paper is transparent to allow the marking to be visible to a consumer. Preferably, the marking is provided on a portion of the smoking article 10 that is not combusted during use, such as on the plug wrap 60 or a portion of the tipping paper 50 that overlies the filter 30.

While the smoking article depicted in FIG. 2 is a cigarette and wrappers 40, 50, 60 are cigarette paper, tipping paper and plug wrap, it will be understood that other smoking articles may have similar wrappers, components or surfaces on or in which a colour shifting marking may be provided.

Figure 3A:
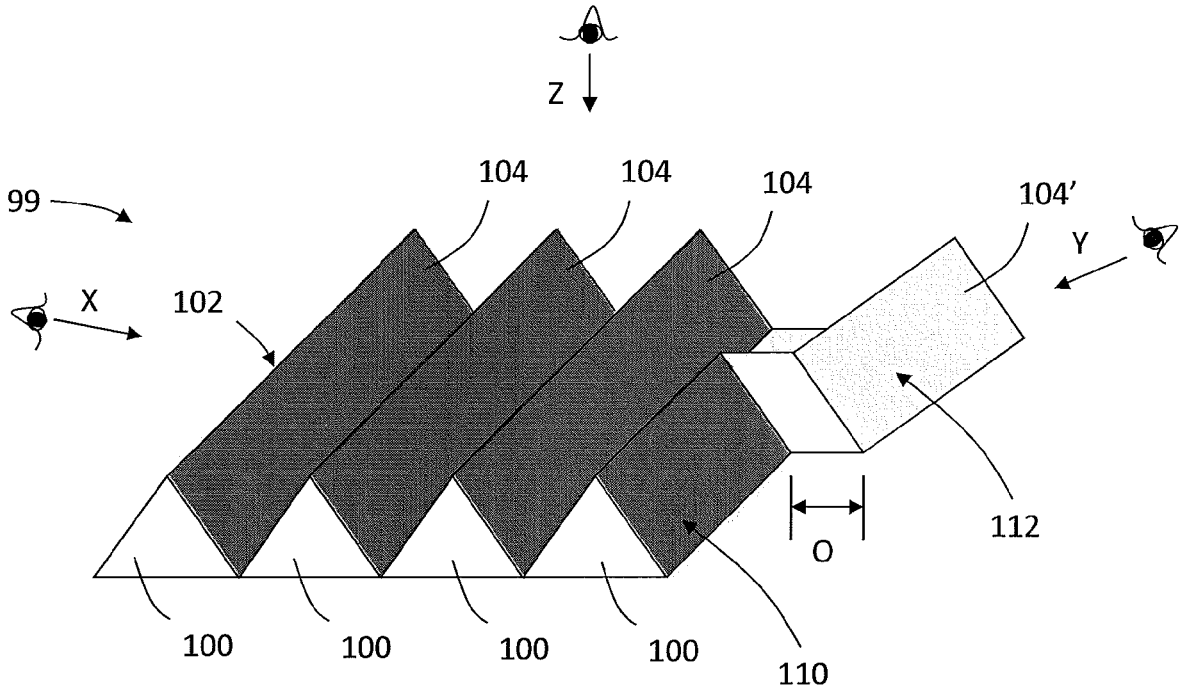
Figure 3B:
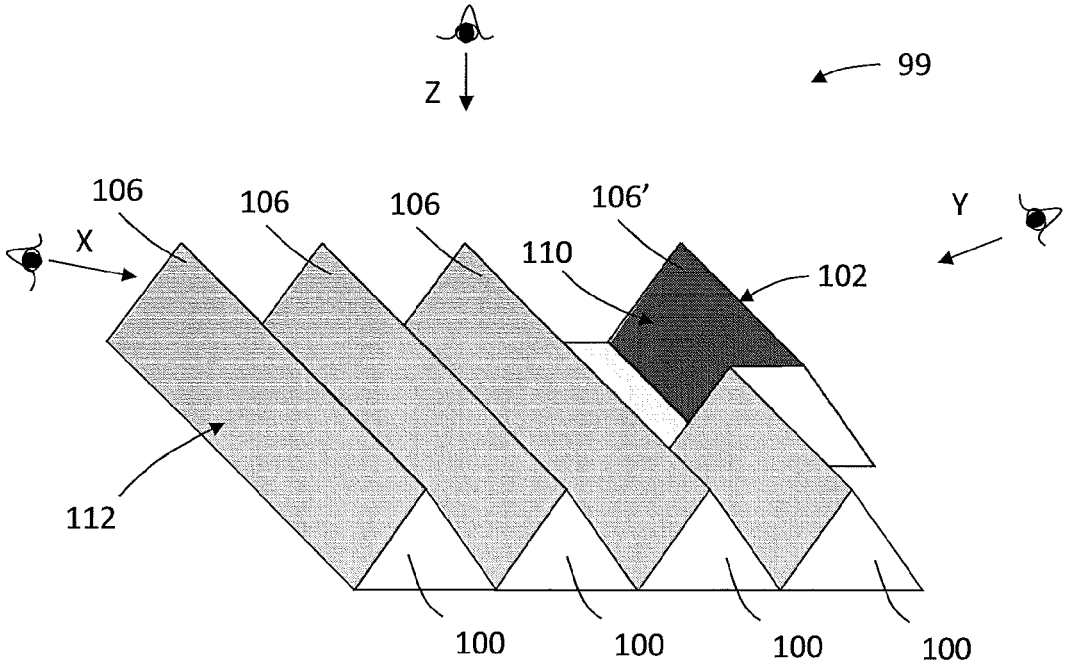

Referring now to FIGS. 3A-D, a marking 99 is shown. In FIGS. 3A and 3B, generally opposing perspective views are shown. The marking 99 includes adjacent printed strips 110, 112 and embossed features 100 having peaks 102 at the intersection of the adjacent printed strips 110, 112. The printed strips alternate between a first coloured strip 110 (for example, blue) and a second coloured strip 112 (for example, yellow). In a first region, the printed strips 110, 112 are aligned with the embossed features 100 such that a strip 110 of the first colour is on a first side 104 of the embossed feature 100 and a strip 112 of the second colour is on a second side 106 of the embossed feature 100. In this region, when viewed from a first angle (Y), the first colour 110 is visible. When viewed from a second angle (X), the second colour 112 is visible. When viewed from a third angle (Z), both sides 104, 106 of the embossed features 100 are visible and thus both colours 110, 112 are visible. If the width of the coloured strips 110, 112 and embossed features 100 are sufficiently small, the colours of the first and second strips 110, 112 blend to produce a third colour (for example, blue+yellow=green).

In a second region, the printed strips 110, 112 are misaligned with the embossed features 110. As depicted in FIG. 3A, the misalignment is such that the printed and embossed features are offset by a distance (O) equal to the width of one printed strip, which is also the width of one embossed feature 100 in the depicted embodiment. In this region, the second colour 112 is provided on the first side 104' of an embossed feature 100. Similarly, in the depicted embodiment, the first colour 110 is provided on the second side 106' of an embossed feature 100.

Figure 3C:
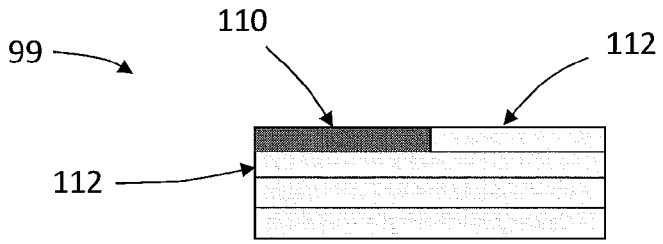

FIG. 3C illustrates an example of what may be seen when the marking 99 is viewed from the second angle (X). In this case, in the area of misalignment, the first colour 110 will be visible, while the second colour 112 is visible in the area of alignment.

Figure 3D:
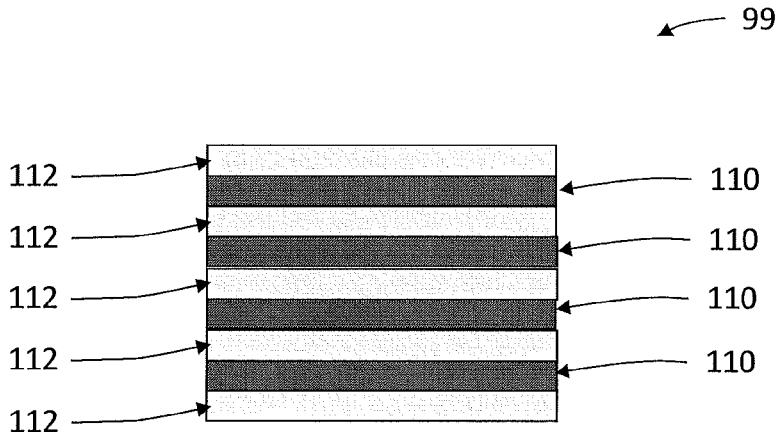

FIG. 3D illustrates an example of what may be seen when the marking 99 is viewed from the third angle (Z). Alternating first 110 and second 112 coloured strips will be seen, even in the area of misalignment. If the strips are of sufficiently small width, the colours will be viewed as a blended colour. Accordingly, the feature (first colour 110 in background of second colour 112) depicted in FIG. 3C is hidden when viewed from angle Z as depicted in FIG. 3D but visible when viewed from angle X as depicted in FIG. 3C.

Figure 4A:
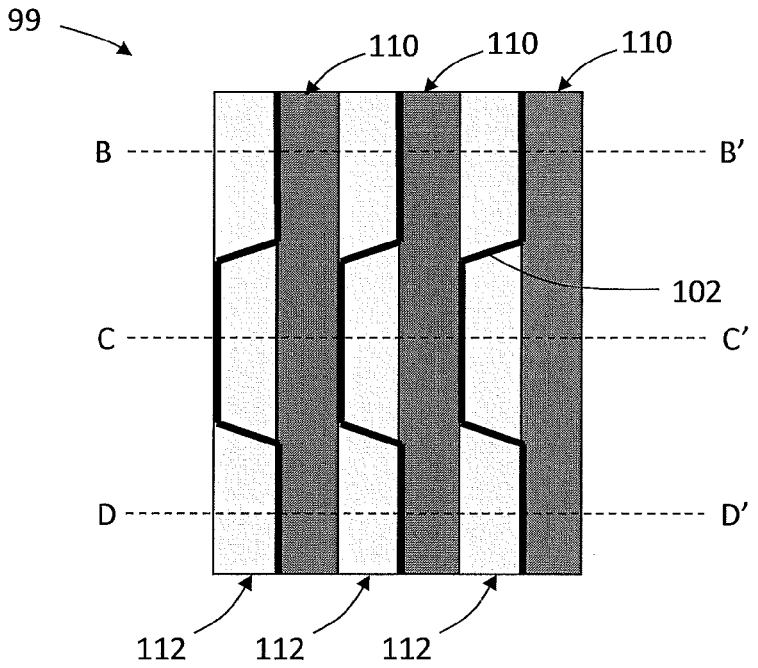
Figure 4B:
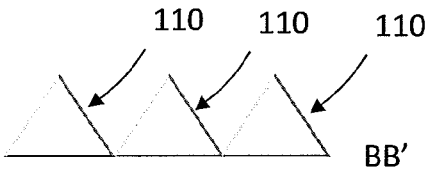
Figure 4C:
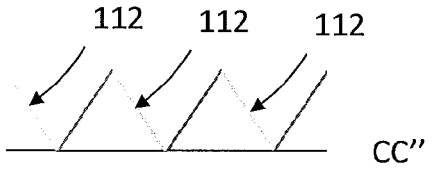
Figure 4D:
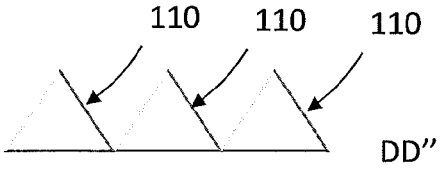

FIGS. 4A-D are different views showing that features of a marking 99 that are hidden in one view may appear when viewed from a different angle. FIG. 4A is a top-down view, such as viewed from angle Z in FIG. 3, of a marking 99 having alternating strips of different colours 110, 112. In certain portions, such as those through lines B-B' and D-D', the peaks 102 of embossed features are aligned with the intersection of the different coloured strips 110, 112. At the portion that includes the section that runs through line C-C' the printed pattern and the embossed pattern are misaligned, such that the peak 102 is offset by the width of one printed strip. As shown in FIGS. 4B-D, when different portions of the marking 99 are viewed from the same angle, different colours are visible depending on whether the portion includes aligned or misaligned printed and embossed patterns. As shown in FIGS. 4B and 4D, which are sections through lines B-B' and D-D' respectively, the embossed features and printed features are aligned and the first colour 110 is visible when viewed from the first angle. As shown in FIG. 4C, which is a section through line C-C', the embossed features and printed features are misaligned (offset) and the second colour 112 is visible when viewed from the first angle.

Referring now to FIGS. 5A and 5B, generally opposing perspective views of markings are shown in which coloured portion 120 is adjacent a patterned portion having adjacent strips of a first colour 110 and a second colour 112 aligned with embossed features 100. In the depicted embodiment the adjacent coloured portion 120 surrounds the patterned portion. The embossed features 100 have a first side on which the first colour 110 is provided and a second side on which the second colour 112 is provided. When viewed from an angle generally orthogonal to the first side of the embossed features 100, the first colour 110 is visible (see FIG. 5B). When viewed from an angle generally orthogonal to the second side of the embossed features 100, the second colour 112 is visible (see FIG. 5A). When viewed from an angle between these two angles (for example, top-down), the colours 110, 112 on either side of the embossed features 100 blend to produce a colour the same or substantially the same as the adjacent portion 120. Accordingly, indicia produced by the patterned region are hidden or become one with the adjacent portion when viewed from certain angles and is visually distinct from the adjacent portion when viewed from different angles.

Referring now to FIGS. 6A and 6B, generally opposing perspective views of markings are shown. The marking includes a patterned portion having adjacent strips of a first colour 110 and a second colour 112 aligned with embossed features 100 or a first colour 110 and a third colour 114 aligned with embossed features 100. The embossed features 100 have a first side on which the first colour 110 is provided and a second side on which the second colour 112 or third colour 114 is provided. When viewed from an angle generally orthogonal to the first side of the embossed features 100, the first colour 110 is visible (see FIG. 6B). When viewed from an angle generally orthogonal to the second side of the embossed features 100, the second colour 112 and the third colour 114 are visible (see FIG. 6A). When viewed from an angle between these two angles (for example, top-down), the colours 110, 112 or 110, 114 on either side of the embossed features 100 blend to produce a fourth or fifth colour, respectively. The coloured features are thus of sufficiently small widths that they blend when viewed from an appropriate angle. Preferably, the features are of a width of about 10 micrometers or less, such as about 5 micrometers or less, about 2 micrometers or less, or about 1 micrometer or less. Generally, the features will be of a width of about 50 nanometers or greater, such as about 100 nanometers or greater or 500 nanometers or greater. In embodiments, the strips are from about 1 micrometer to about 8 micrometers in width. In such a manner, indicia produced by the patterned portion are hidden when viewed from the first angle, but are visible when viewed from the second angle. The indicia are visible in different colours when viewed from an angle between the first and second angles (such as top-down in the drawing depicted).

The invention claimed is:

1. A smoking article comprising:

a marking comprising a patterned portion and an adjacent portion, wherein the patterned portion comprises a printed pattern and an embossed pattern aligned with the printed pattern, the printed pattern comprises a portion having a first colour and an adjacent portion having a second colour, wherein the first colour of the printed pattern is provided on a side of an embossed feature visible from a first angle when viewed by a user grasping the smoking article and the second colour of the printed pattern is provided on a second side of the embossed feature visible from a second angle when viewed by the user grasping the smoking article, wherein the portion having the first colour and the portion having the second colour are of sufficiently small widths when viewed from a third angle by the user grasping the smoking article that the first colour and the second colour blend to produce a third colour, wherein the widths of the portion having the first colour and the portion having the second colour of the printed pattern are about 10 micrometers or less; and wherein the adjacent portion of the marking is provided with one of the first, second or third colours.

2. A smoking article comprising:

a marking comprising a printed pattern and an embossed pattern aligned with the printed pattern;

wherein the printed pattern comprises a portion having a first colour and an adjacent portion having a second colour, wherein, in a first portion, the embossed pattern is in register with the printed pattern, such that the portion having the first colour is on a first side of an embossed feature visible from a first angle when viewed by a user grasping the smoking article and the portion having the second colour is on a second side of the embossed feature visible from a second angle when viewed by the user grasping the smoking article, and wherein, in a second portion, the embossed pattern is offset relative to the printed pattern, such that the portion having the second colour is on a side of an embossed feature visible from the first angle when viewed by the user grasping the smoking article, and wherein the portion having the first colour and the adjacent portion having the second colour are of sufficiently small widths when viewed from a third angle by the user grasping the article that the first colour and the second colour blend to produce a third colour, and wherein the widths of the portion having the first colour and the portion having the second colour of the printed pattern are about 10 micrometers or less.

3. A smoking article according to claim 2, wherein in the second portion of the visible area where the embossed pattern is offset relative to the printed pattern, the portion having the first colour is on a side of an embossed feature visible from the second angle.

4. A smoking article according to claim 2, wherein the widths of the portion having the first colour and the portion having the second colour of the printed pattern are about 5 micrometers or less.

5. A smoking article according to claim 2, wherein the widths of the portion having the first colour and the portion having the second colour of the printed pattern are from about 1 micrometers to about 8 micrometers.

6. A smoking article according to claim 2, wherein the portion having the first colour and the portion having the second colour of the printed pattern are provided as strips.

7. A smoking article according to claim 2, wherein the smoking article comprises a wrapper and wherein the marking is provided on the wrapper.

8. A smoking article according to claim 2, further comprising:

a filter portion wrapped by a filter plug wrapper;

a rod of smokable material wrapped by a smokable material wrapper; and a tipping wrapper surrounding at least a portion of the filter portion and at least a portion of the rod of smokable material, wherein the marking is provided on at least one of the filter plug wrapper, the smokable material wrapper or the tipping wrapper.

9. A smoking article according to claim 1, wherein the widths of the portion having the first colour and the portion having the second colour of the printed pattern are about 5 micrometers or less.

10. A smoking article according to claim 1, wherein the widths of the portion having the first colour and the portion having the second colour of the printed pattern are from about 1 micrometers to about 8 micrometers.

11. A smoking article according to claim 1, wherein the portion having the first colour and portion having the second colour of the printed pattern are provided as strips.

12. A smoking article according to claim 1, wherein the smoking article comprises a wrapper and wherein the marking is provided on the wrapper.

13. A smoking article according to claim 1, further comprising:

a filter portion wrapped by a filter plug wrapper;

a rod of smokable material wrapped by a smokable material wrapper; and a tipping wrapper surrounding at least a portion of the filter portion and at least a portion of the rod of smokable material, wherein the marking is provided on at least one of the filter plug wrapper, the smokable material wrapper or the tipping wrapper.

14. A smoking article according to claim 1, wherein the adjacent portion of the marking is provided with one of the first, second or third colours.

15. A smoking article comprising:

a marking comprising a printed pattern and an embossed pattern aligned with the printed pattern;

wherein the printed pattern comprises a first portion and a second portion, the first portion of the printed pattern comprising a portion having a first colour and an adjacent portion having a second colour, and the second portion of the printed pattern comprising a portion having the first colour and an adjacent portion having the third colour;

wherein, in the first portion, the embossed pattern is in register with the printed pattern, such that the portion having the first colour is on a first side of an embossed feature visible from a first angle by a user grasping the smoking article and the portion having the second colour is on a second side of the embossed feature visible from a second angle by the user grasping the smoking article, wherein, in the second portion, the embossed pattern is in register with the printed pattern, such that the portion having first colour is on a side of an embossed feature visible from the first angle when viewed by the user grasping the article and the portion having the third colour is on a second side of the embossed feature visible from the second angle when viewed by the user grasping the article, wherein the portion having the first colour and the adjacent portion having the second colour are of sufficiently small widths when viewed from a third angle that the first colour and the second colour blend when viewed by the user grasping the smoking article from the third angle to produce a fourth colour, and wherein the widths of the portion having the first colour and the portion having the second colour of the printed pattern are about 10 micrometers or less.

16. A smoking article according to claim 15, wherein the portion having the first colour and the adjacent portion having the third colour are of sufficiently small widths when viewed from the third angle that the first colour and the second colour blend to produce a fifth colour.

17. A smoking article according to claim 15, wherein the widths of the portion having the first colour and the portion having the second colour of the printed pattern are about 5 micrometers or less.

18. A smoking article according to claim 15, wherein the widths of the portion having the first colour and the portion having the second colour of the printed pattern are from about 1 micrometers to about 8 micrometers.

19. A smoking article according to claim 15, wherein the portion having the first colour and the portion having the second colour of the printed pattern are provided as strips.

20. A smoking article according to claim 15, wherein the smoking article comprises a wrapper and wherein the marking is provided on the wrapper.

21. A smoking article according to claim 15, further comprising:

a filter portion wrapped by a filter plug wrapper;

a rod of smokable material wrapped by a smokable material wrapper; and a tipping wrapper surrounding at least a portion of the filter portion and at least a portion of the rod of smokable material, wherein the marking is provided on at least one of the filter plug wrapper, the smokable material wrapper or the tipping wrapper.

* * * * *